US006149772A

United States Patent [19]

Rasmussen

[11] Patent Number: 6,149,772

[45] Date of Patent: Nov. 21, 2000

[54] MODULAR MOULDING TOOLS FOR USE IN A MACHINE FOR MANUFACTURING SHELLS OR THIN-WALLED BLANKS FROM PULP MATERIAL

[75] Inventor: Torben Rasmussen, Lyngby, Denmark

[73] Assignee: Brodrene Hartmann A/S, Lyngby, Denmark

[21] Appl. No.: 09/227,823

[22] Filed: Jan. 11, 1999

Related U.S. Application Data

[63] Continuation of application No. 08/530,316, filed as application No. PCT/DK94/00150, Apr. 13, 1994, abandoned.

[30] Foreign Application Priority Data

Apr. 15, 1993 [DK] Denmark ..... 0429/93

[51] Int. Cl.[7] ..... D21J 3/00

[52] U.S. Cl. ..... 162/383; 162/416; 162/411

[58] Field of Search ..... 162/218, 416, 162/411, 383, 227; 425/84, 85, 183; 249/156

[56] References Cited

U.S. PATENT DOCUMENTS

| | | | |
|---|---|---|---|
| 2,903,062 | 9/1959 | Lambert | 162/411 |
| 3,553,079 | 1/1971 | Hornbostel, Jr. | 162/383 |
| 5,656,135 | 8/1997 | Baker | 162/388 |

FOREIGN PATENT DOCUMENTS

| | | |
|---|---|---|
| 66-5138 | 7/1968 | Sweden . |
| 627841 | 8/1949 | United Kingdom . |
| 708393 | 5/1954 | United Kingdom . |
| WO 93/17183 | 9/1993 | WIPO . |

*Primary Examiner*—Brenda A. Lamb
*Attorney, Agent, or Firm*—Pennie & Edmonds LLP

[57] ABSTRACT

The mutually associated moulding tools, such as a suction mould and an associated pressing-and-depositing mould, neither of which are shown, comprise a baseplate (1) with a modularly divided, rectangular area (2) provided with perforations (3), on which area (2) it is possible to secure, e.g. by means of screws, a number of closely adjacent modular mould parts (A,B) with a rectangular outline, each of the modular mould parts (A,B) serving to produce an article (C,D,E) to be separated from the pulp-material shell having been produced in a subsequent operation. With this arrangement, it is possible to keep the cost of manufacturing the moulding tools and the time required for re-arranging them at such low levels, that even small series of articles (C,D,E) may be manufactured profitably.

18 Claims, 5 Drawing Sheets

MODULAR MOULDING TOOLS FOR USE IN A MACHINE FOR MANUFACTURING SHELLS OR THIN-WALLED BLANKS FROM PULP MATERIAL

CROSS-REFERENCE TO RELATED APPLICATIONS

This is a continuation of application Ser. No. 08/530,316, filed Oct. 4, 1995, now abandoned, which was the National Stage of International Application No. PCT/DK94/00150, filed Apr. 13, 1994.

TECHNICAL FIELD

The present invention relates to modular moulding tools of the kind set forth in the preamble of claim 1.

BACKGROUND ART

In a machine for manufacturing shells or thin-walled blanks from pulp material, the suction moulds may be permanently secured to a first rotor, with which they are moved in sequence through a container with a watery suspension of fibers of pulp material, during this movement by means of vacuum a shell of pulp material is aspired on to the liquid-permeable moulding surface. The pulp shell having been aspirated on to the moulding surface is now "rinsed", i.e. sprinkled with water, after which the suction mould is pressed together with an associated pressing-and-depositing mould suspended in a second rotor in the machine, and whilst applying pressurized air to the suction mould and vacuum to the associated pressing-and-depositing mould, the pulp-shell is transferred from the suction mould to the pressing-and-depositing mould, the latter by the continued turning on the second rotor being moved to a position above a pendularly suspended drying plate of an endless drying conveyor, on which the pulp shell is deposited by applying pressurized air to the pressing-and-depositing mould. Then, the moist pulp shells thus deposited are conveyed on the drying plates through a drier, so that they are dried, after which the dried pulp shells may be subjected to various post-processing steps as described in DK patent application No. 0763/92, before finally being subjected to a simple punching step, separating the individual articles being produced from the remainder of the pulp shell.

When used for manufacturing great numbers of articles, such a process of manufacture is simple and cheap to carry out, as especially the relatively high cost of manufacturing the mutually associated suction moulds and pressing-and-depositing moulds may in this manner be distributed over the very great number of articles manufactured.

When it comes to manufacturing a moderate number of articles, it is possible to let some of the mutually associated suction moulds and pressing-and-depositing moulds being mounted on and suspended in the two rotors respectively, be different from the remaining moulds. This will, however, entail the disadvantage of having to sort the dried pulp shells according to the type of articles manufactured on them, and then carry out the post-processing, including the punching-out, of the individual articles in separate post-processing lines. Even though this makes it possible to exploit the full capacity of the machine for manufacturing pulp shells, it is necessary in this case to distribute the cost of manufacturing the various mutually associated suction moulds and pressing-and-depositing moulds over a smaller number of articles, making the process of manufacture less profitable, and the same applies to the sorting of the various pulp shells and the post-processing of these in separate post-processing lines. Further, the requisite exchanging of the moulding tools cause the down time, of the machine, during which its capacity cannot be exploited, to be lengthened.

The disadvantages referred to above are, of course, even more noticeable, when the number of articles to be produced is even smaller, possibly making the cost of manufacturing the moulding tools prohibitive for such a production.

DISCLOSURE OF THE INVENTION

It is on this background the object of the present invention to provide modular moulding tools of the kind referred to, which, without extended down times for the machine for manufacturing pulp shells, and while they are still mounted or suspended in the machine, may be altered from the production of one set of articles to the production of another set of articles, so as to reduce the costs of the moulding tools and hence make it possible to manufacture smaller series of articles in a profitable manner, said alteration having to be carried out in the shortest possible time.

Accordingly, the present invention is directed toward a moulding tool for use in a machine for manufacturing individual articles from pulp material by aspirating a layer of pulp material from a liquid suspension on a liquid-permeable moulding surface. The moulding tool includes a suction mould and an associated pressing-and-depositing mould. Each mould is configured and dimensioned to be secured in a pressure-tight manner to a low, elongated box enclosing a chamber adapted to be sequentially connected to a vacuum source and a pressurized-air source, respectively. The suction and pressing-and-depositing moulds include mutually facing elements adapted to moulding of the individual articles. Each suction and pressing-and-depositing mould includes a substantially planar baseplate provided with a plurality of perforations to form the base of the elongated box.

The improvement includes the baseplate having a modularly divided area which is dividable into a plurality of modules; a plurality of modular mould parts for securing to the baseplate; and means for masking-off any regions of the modularly divided area on the baseplate not covered by modular mould parts. The plurality of modular mould parts are provided in a number corresponding to the number of individual articles. The modular mould parts are configured and dimensioned to form a respective one of the individual articles and have a base surface disposed parallel to the baseplate, and are provided with either projections or recesses. The modular mould parts are removably secured in the modularly divided area of the baseplate and are positioned substantially adjacent to each other to at least partially cover the modularly divided area.

The means for masking-off are removably secured in the modularly divided area in any regions of the modularly divided area on the baseplate not covered by the modular mould parts. The moulding tool of the invention produces a coherent pulp shell having the individual articles formed therein such that the articles are separable from each other after drying of the pulp material shell in a drying plate of a drier.

In one embodiment of the invention, a male suction mould is utilized. The male suction mould includes a modularly divided area of the baseplate delimited by a frame, which forms the outer side wall of the low elongated box. Each modular mould part of the male suction mould includes a hollow body, at least one projection protruding upwardly from the base surface, and side walls extending at right angles therefrom towards the baseplate of the male suction mould. The base surface and the projection or projections are provided with a plurality of perforations and covered with wire mesh extending through a distance downwardly along and aligned with the side walls of the modular mould part of the male suction mould at right angles to the base surface. The base surfaces of each modular mould part lies in substantially the same plane, at a lower level than an upper edge of the frame of the male suction mould by one wall thickness of the pulp-material shells. The masking means of the male suction mould may be a masking body or masking bodies. The masking bodies may include a hollow body, with a masking surface lying in the plane of the modular mould parts of the male suction mould and masking side walls extending at right angles towards the baseplate. The masking surfaces may be provided with perforations and covered with wire mesh extending through a distance downwardly along and aligned with the masking side walls at right angles to the plane of the modular mould parts of the male suction mould.

In another embodiment of the invention, a female suction mould is utilized. The female suction mould includes a modularly divided area on the baseplate that is delimited by a frame. The frame forms an outer side wall of the low, elongated box. Each modular mould part of the female suction mould includes a body having in outlines a right angled box-like shape. The sides and bottom of the body are provided with recesses open towards the baseplate of the female suction mould. The body includes side walls extending at right angles from the base surface and at least one moulding recess extending from the base surface downwardly in the body and surrounded by the recesses. The base surface of the female suction mould and each moulding recess are covered with wire mesh extending through a distance downwardly along and aligned with the side walls of the modular mould parts of the female suction mould. Each moulding recess and the base surface of the female suction mould are provided with perforations extending to the recesses. The base surfaces of the modular mould parts of the female suction mould lie in substantially the same plane as the female suction mould, at a level lower than the level of the upper edge of the frame by substantially one wall thickness of the pulp-material shell. The masking means of the female suction mould may be a masking body or bodies that include a hollow body open towards the baseplate of the female suction mould, with a plane surface of the masking body lying in the plane of the female suction mould. Side walls of the masking body extend at right angles from the body. The plane surface of the bodies are provided with perforations and covered with wire mesh that extends through a distance along and aligned with the side walls of the masking bodies.

BRIEF DESCRIPTION OF THE DRAWINGS

In the following detailed portion of the present description, the invention will be explained—in more detail with reference to the drawings, in which FIG. 1 diagrammatically shows a baseplate with a modularly divided rectangular area provided with perforations.

DESCRIPTION OF THE PREFERRED EMBODIMENTS

Figure 1:
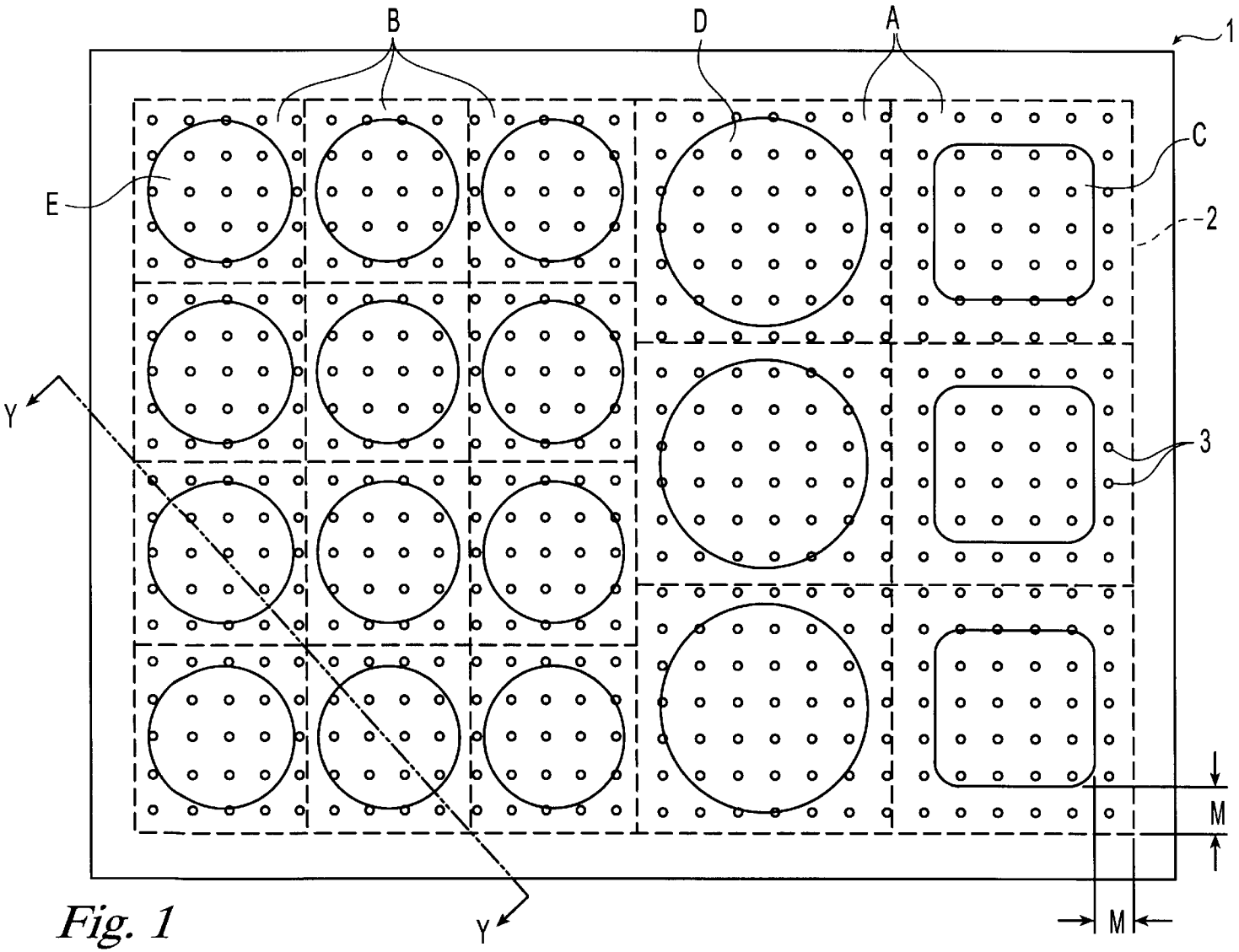

FIG. 1 shows diagrammatically a baseplate 1, that is common to the modular moulding tools according to the invention and comprises a rectangular area 2, the latter being divided into square modules with an edge length m, in the embodiment shown 20×28 such modules, and provided with perforations 3.

In FIG. 1, the right-hand side of the rectangular, modularly divided area 2 is shown covered with six approximately square modular mould parts A, while in a similar manner, the left-hand side of the area is shown as being covered with twelve approximately square-modular mould parts B.

It will be understood that the horizontal edge length of the modular mould parts A is 7.000×m, while their vertical edge length is 6.667×m. Similarly, it will be understood that the horizontal edge length of the modular mould parts B is 4.667×m, while their vertical edge length is 5.000×m.

With the same coverage of the area 2, the right-hand side of the area could comprise three rectangular modular mould parts with a length of 14.000×m and a width of 6.667×m, or one such rectangular modular mould part and two rectangular mould parts with the length 13.333×m and the width 7.000×m.

Similarly, it would be possible to cover the left-hand half of the area 2 with rectangular modular mould parts with the length 10.000×m and the width 4.667×m or with the length 9.3343×m and the width 5.000×m.

From the example described above, being—of course—in no manner limiting, as a skilled person will be free to choose a different modular division of the area 2 as well as different edge lengths for the modular mould parts, it will be possible to understand that the individual modular mould parts do not necessarily have to cover an integral number of modules on the modularly divided area, and also that, with a relatively simple modular division shown in the example, it is possible to use modular mould parts with a series of different dimensions. Further, only the regions covered by the articles C, D and E will be used, since the remaining regions appearing in a thin-walled pulp object manufactured by using, a modular moulding tool as shown will be rejected in the form of recyclable waste when the articles are punched out. On this background it is understandable that it is preferred to make the articles C, D and E respectively occupy the area covered by the modular mould parts A and B respectively to the greatest possible extent.

Figure 2:
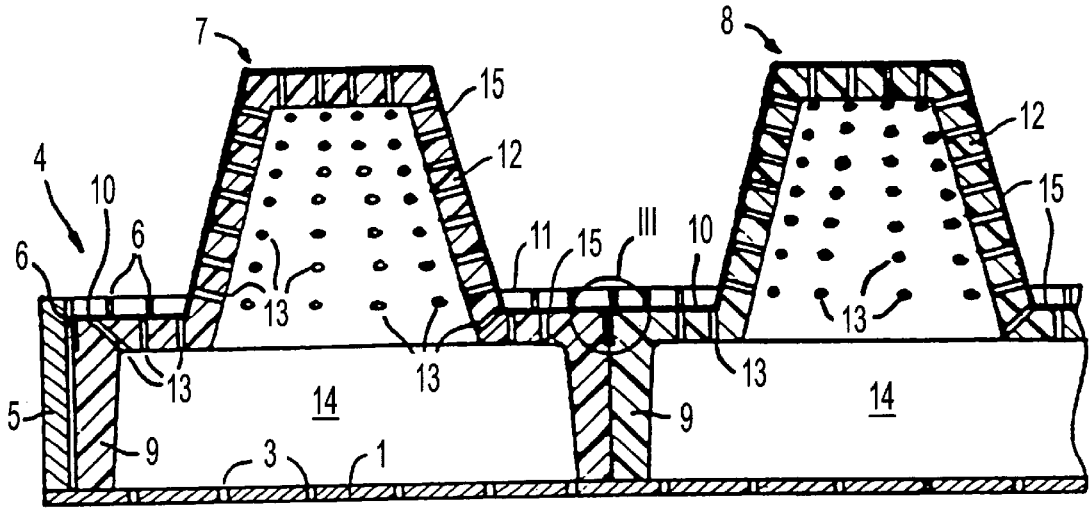
FIG. 2 is a diagrammatic partial cross-sectional view through the edge of a male
Figure 3:
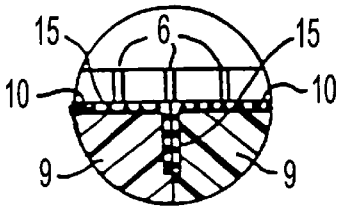

FIG. 2 is a partial cross-sectional view through the edge of a male suction mould generally designated 4 and consisting of a baseplate 1 as shown in FIG. 1, the modularly divided, rectangular area of which is provided with perforations 3 and bounded by a frame 5, the internal surface of which is provided with substantially vertical grooves 6 extending close to each other. The modular mould part generally designated 7 is secured immediately adjacent to the frame 5 by means of screws (not shown), and in the same manner and immediately adjacent to the mould part 7, a second modular mould part generally designated 8 is secured. In the Figure, the modular mould parts 7 and 8 are shown as being identical, but it will be understood that they may differ from each other. Each of the modular mould parts 7 and 8 consists of a hollow body 9 of plastic or metal and has a base surface 10. The base surfaces 10 lie in the same horizontal plane parallel to the baseplate 1 and at a level lower than the top edge 11 of the frame 5 by substantially one wall thickness of a pulp body aspirated onto the suction mould. Protruding upwardly from each of the base surfaces 10 is a projection 12, and from the external surfaces of the projections 12 and from the base surface 10 perforations 13 lead to the internal cavity 14 in each of the hollow bodies 9. The base surfaces 10 and the external surfaces of the projections 12 are covered with wire mesh 15, according to a special feature of the invention extending through a small distance along and aligned with the upright sides of the modular mould parts 7 and 8, seen most clearly in FIG. 3. The effect of this feature is that pulp material will be aspirated across the dividing lines, between the individual modular mould parts 7 and 8 and between the modular mould part 7 and the frame 5.

Figure 2A:
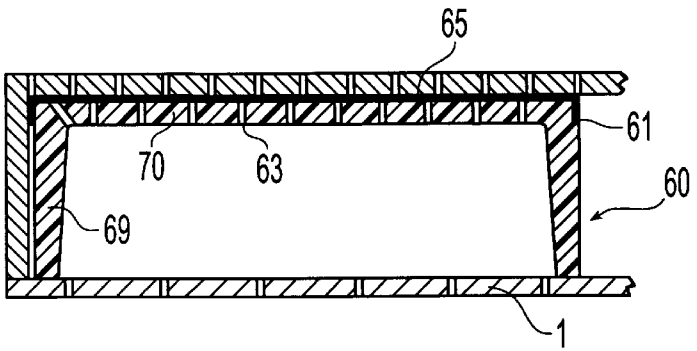
FIG. 2*a* is a partial cross-sectional view through the edge of a masking body for use adjacent a male suction mould such as shown in FIG. 2, suction mould according to the invention, FIG. 3 at a larger scale shows the part of FIG. 2 framed by a circle III.

It is possible to use a masking body 60, as shown in FIG. 2*a*, to cover a region of the modularly divided area in a suction mould 4 according to the invention not covered with modular mould parts. Such a masking body 60 may be a hollow body 69 of plastic or metal with a perforated 63 base surface 70 lying in the same plane as the base surfaces 10 of the modular mould parts 7 and 8 and being covered with wire mesh 65 extending through a short distance downwardly along the upright sides 61 of the masking body 60. The masking body 60 may be secured to the baseplate (1) by means of screws (not shown).

Figure 4:
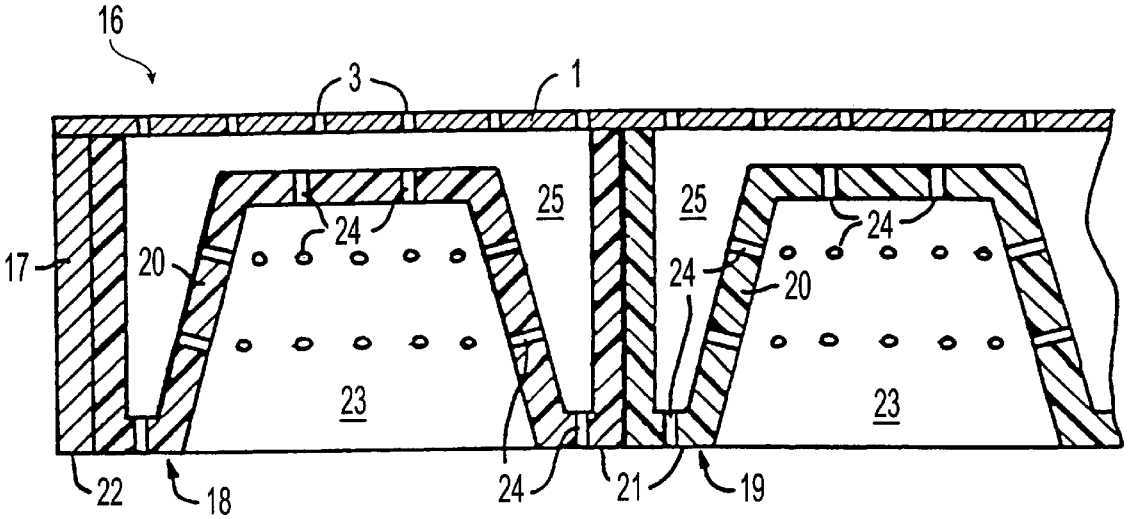
FIG. 4 is a sectional view corresponding to FIG. 2 through a pressing-and-depositing mould cooperating with the male suction mould shown in FIG. 2.

FIG. 4 shows a pressing-and-depositing mould generally designated 16 in partial sectional view corresponding to the partial sectional view of the male suction mould 4 shown in FIG. 2 and with which the mould 16 is adapted to cooperate. Even the pressing-and-depositing mould 16 consists of a baseplate 1 as shown in FIG. 1, the modular divided, rectangular area of which, provided with perforations 3, is delimited by a frame 17. A modular mould part generally designated 18 is situated immediately adjacent to the frame 17, and a modular mould part generally designated 19 is situated immediately adjacent to the mould part 18, being of identical shape to the latter. Each of the modular mould parts 18 and 19 consists of a hollow body 20 of plastic or metal, each having a base surface 21 parallel to the baseplate 1 and substantially in the same plane as the edge 22 of the frame 17. said hollow bodies 20 being secured to the baseplate 1 by means of screws (not shown).

Each of the modular mould parts 18 and 19 comprise a recess 23 extending from the base surface 21 and situated in positions in the pressing-and-depositing mould 16 corresponding to the positions of the projections 12 on the suction mould shown in FIG. 2, each of the recesses 23 having dimensions larger than the dimensions of the projections 12 on the suction mould 4, by approximately one wall thickness of a pulp shell aspirated onto the suction mould 4.

In each of the modular mould parts 18 and 19, the recess 23 and the base surface 21 are provided with perforations 24 leading to the internal cavity 25 in the hollow body 20.

When a pulp shell has been aspirated onto the male suction mould 4 of FIG. 2, and when this male suction mould 4 is pressed together with the pressing-and-depositing mould 16 shown in FIG. 4, it is possible to transfer the pulp shell from the suction mould 4 to the pressing-and-depositing mould 16 by applying air under pressure to the cavities 14 in the suction mould 4 and applying vacuum to the cavities 25 in the pressing-and-depositing mould 16.

When the pressing-and-depositing mould 16 has been conveyed to a position immediately above a drying plate in the drier (not shown), it is possible to deposit the pulp shell on the drying plate for drying by supplying air under pressure to the cavities 25 in the pressing-and-depositing mould 16.

Figure 5:
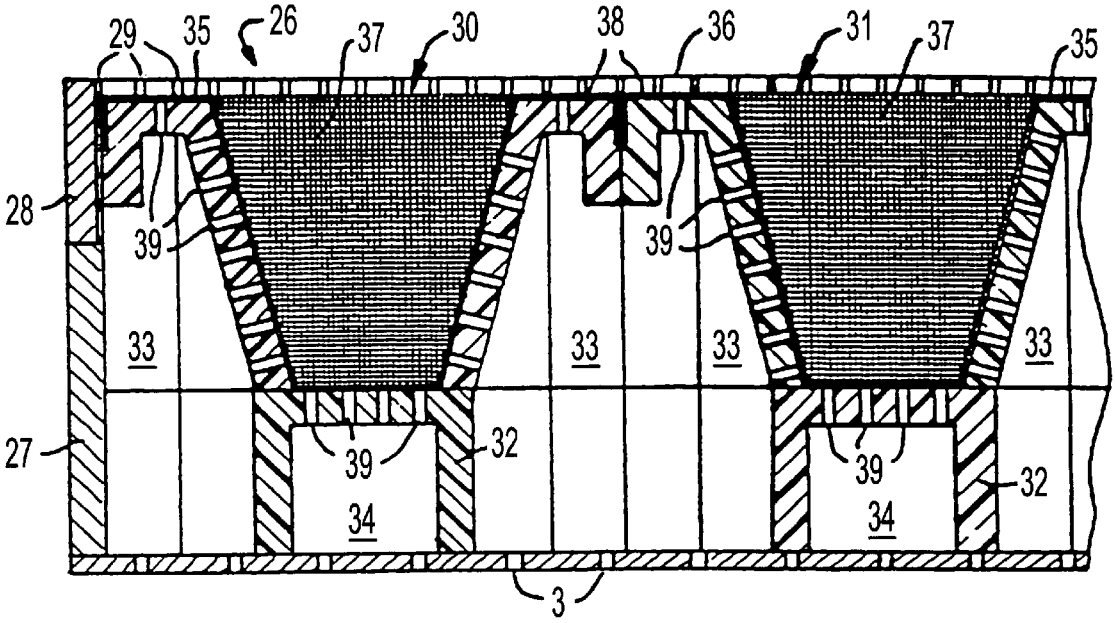
FIG. 5 is a diagrammatic partial cross-sectional view through the edge of a female suction mould according to the invention.

FIG. 5 is a partial sectional view taken through the edge of a female suction mould generally designated 26 and comprising a baseplate 1 as shown in FIG. 1, the modularly divided, rectangular area of which, provided with perforations 3, is delimited by a frame consisting of two frame sections 27 and 28, of which the upper frame section 28 on its internal surface comprises approximately vertical grooves 29 placed close together. A modular mould part generally designated 30 is secured to the baseplate 1 by means of screws (not shown) in a position immediately adjacent to the frame 27, 28, and another mould part generally designated 31 is situated in a position immediately adjacent to the mould part 30. In the example shown, the mould part 31 is identical in shape to the mould part 30, but it may have a different shape. Each of the modular mould parts 30 and 31 consists of a body 32 of plastic or metal, the sides and bottom of which are provided with recesses 33 and 34 respectively. Each of the modular mould parts 30 and 31 has a base surface 35, and these base surfaces 35 are preferably lying in the same horizontal plane parallel to the baseplate 1 and at a level lower than the level of the upper edge 36 of the upper frame section 28 by substantially one wall thickness of a pulp shell aspirated onto the female suction mould 26. Each of the modular mould parts 30 and 31 has a moulding recess 37, and these moulding recesses 37 as well as the base surfaces 35 are covered with wire mesh 38, extending through a short distance and aligned with the upright sides of the modular mould parts 30 and 31 as explained with reference to FIG. 3 and having the same effect. Through the body 32 of each of the modular mould parts 30 and 31, perforations 39 extend from the recesses 33 and 34 to the moulding recesses 37 and the base surface 35.

Figure 5A:
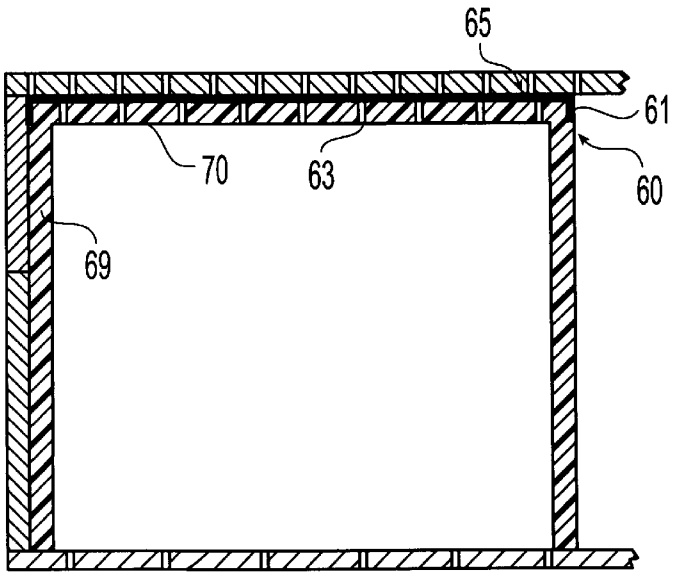
FIG. 5*a* is a partial cross-sectional view through the edge of a masking body for use adjacent a female suction mould such as shown in FIG. 5.

If a masking body 60, as shown in FIG. 5*a*, is used for filling a possibly uncovered region of the modularly divided area of the baseplate 1 in a suction mould 26 according to the invention, this masking body 60 can be a hollow body 69 of plastic or metal with a perforated 63 base surface 70 covered with wire mesh 65 and lying in the same plane as the base surfaces 35 of the modular mould parts 30 and 31. In this case also, the covering of wire mesh 65 extends downwardly through a short distance along and aligned with the upright sides 61 of the masking body 60. The masking body 60 may be secured to the baseplate 1 by means of screws (not shown).

Figure 6:
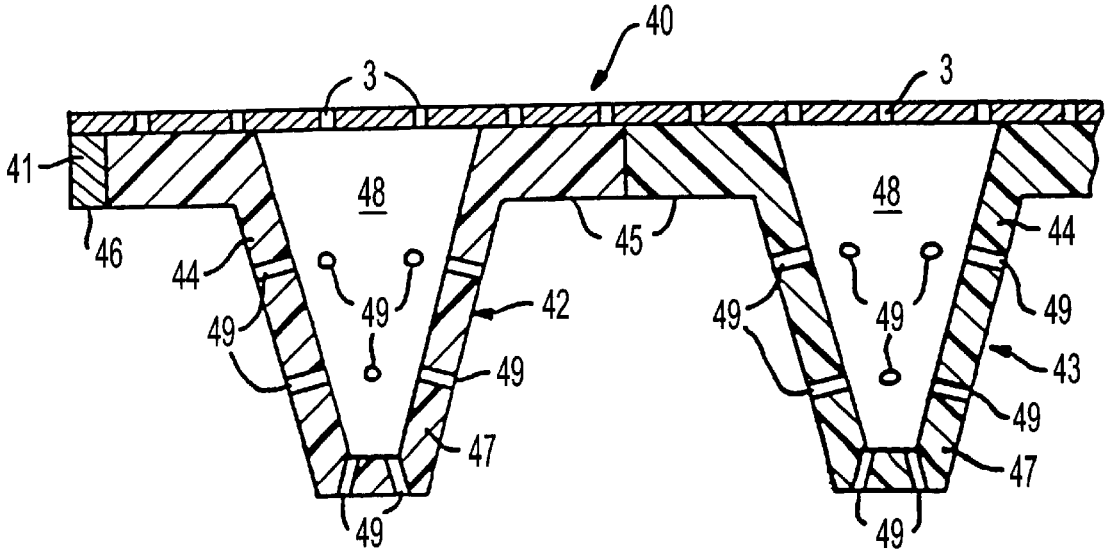
FIG. 6 is a corresponding sectional view through a pressing-and-depositing mould cooperating with the female suction mould shown in FIG. 5.
Figure 4A:
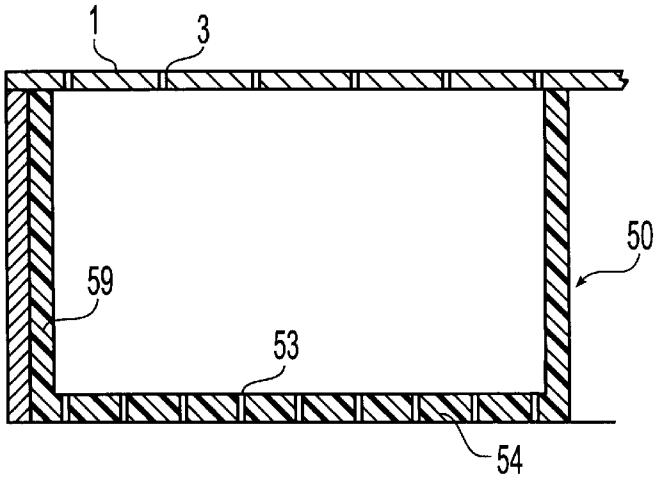
FIG. 4*a* is a partial cross-sectional view through the edge of a masking body for use adjacent a pressing-and-depositing mould as shown in FIG. 4 cooperating with the male suction mould shown in FIG. 4.
Figure 6A:
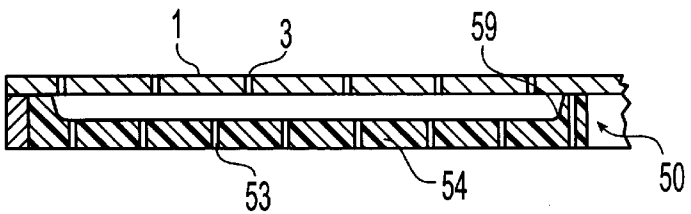
FIG. 6*a* is a partial cross-sectional view through the edge of a masking body for use adjacent a pressing-and-depositing mould as shown in FIG. 6 cooperating with the female suction mould shown in FIG. 5.

If a masking body, as shown in FIGS. 4*a* and 6*a*, is used for filling a possibly uncovered region of the modularly divided area of the baseplate 1 in a pressing-and-depositing mould 16, 40, this masking body 50 can be a hollow body 59 of plastic or metal with a perforated 53 base surface 54 lying in the same plane as the base surfaces 21, 45 of the pressing-and-depositing mould 16, 40. The masking bodies may be secured to the baseplate 1 by means of screws (not shown).

FIG. 6 is a partial sectional view showing the edge of pressing-and-depositing mould generally designated 40, corresponding to the partial sectional view of the female suction mould 26 of FIG. 5. The pressing-and-depositing mould 40 comprises a baseplate 1 as shown in FIG. 1, the modularly divided rectangular area of which is provided with perforations 3 and is delimited by a frame 41. A modular mould part generally designated 42 is placed in a position immediately adjacent to the frame 41, and another modular mould part generally designated 43, identical in shape to the modular mould part 42, is placed in a position immediately adjacent to the latter. Each of the modular mould parts 42 and 43 consists of a hollow body 44 of plastic or metal and comprises a base surface 45 parallel to the baseplate 1 and lying substantially in the same plane as the edge 46 of the frame 41, as well. as a projection 47 extending from the base surface 45 and situated on the pressing-and-depositing mould 40 in a position corresponding to the position of the mating moulding recess 37 in the female suction mould 26 shown in FIG. 5, each of the projections 47 having dimensions smaller than the dimensions of the mating moulding recess 37 by approximately one wall thickness of the pulp shell aspirated onto the female suction mould 26. Perforations 49 extend from the internal cavities 48 in each of the projections 47 to the external surfaces of the latter.

When a pulp shell has been aspirated onto the female suction mould 26 of FIG. 5, it is possible to transfer the pulp shell to the pressing-and-depositing mould 40 shown in FIG. 6 by pressing the female suction mould 26 together with the associated pressing-and-depositing mould 40 of FIG. 6 and applying air under pressure to the recesses 33 and 34 in the female suction mould 26 and vacuum to the cavities 48 in the pressing-and-depositing mould 40, after which the pulp shell together with the latter mould may be conveyed to a position immediately above a drying plate in a drier, and then deposited on the drying plate by a supplying air under pressure to the cavities 48 in the pressing-and-depositing mould 40.

In this connection it is important that the bottoms of the articles formed in the pulp shell by aspirating pulp material in the moulding recesses 37 in the female suction mould 26 of FIG. 5 either lie in the same plane or, if the articles being produced differ in depth, that the articles having the greatest and the same depth are placed symmetrically along two opposite sides of the pulp shell.

Thus, considering the articles C, D and E shown in FIG. 1, and assuming that the articles C and D have the same depth, and if FIG. 1 is taken to show a female suction mould, it wilt be advantageous to move the innermost row of the modular mould parts A from its position in the right-hand half of the modularly divided area 2 to an extreme left-hand position in the latter. In this manner, the pulp shell will rest on the drying plate in a stable manner, when deposited on the latter by the pressing-and-depositing mould.

Pulp shells or thin-walled pulp bodies produced by means of the male suction mould 4 of FIG. 2 or the female suction mould 26 in FIG. 5 will, between the frame 5 or 28 respectively and the articles situated closest to the latter, have a circumferential edge in the same plane, on which the shells may be placed on a conveying device and conveyed through a post-processing line, the pulp shells in this case preferably as described in DK patent application No. 0763/92 referred to above being shaped with tabs or flaps protruding sideways from the edge and adapted to be engaged by conveying means.

Figure 7:
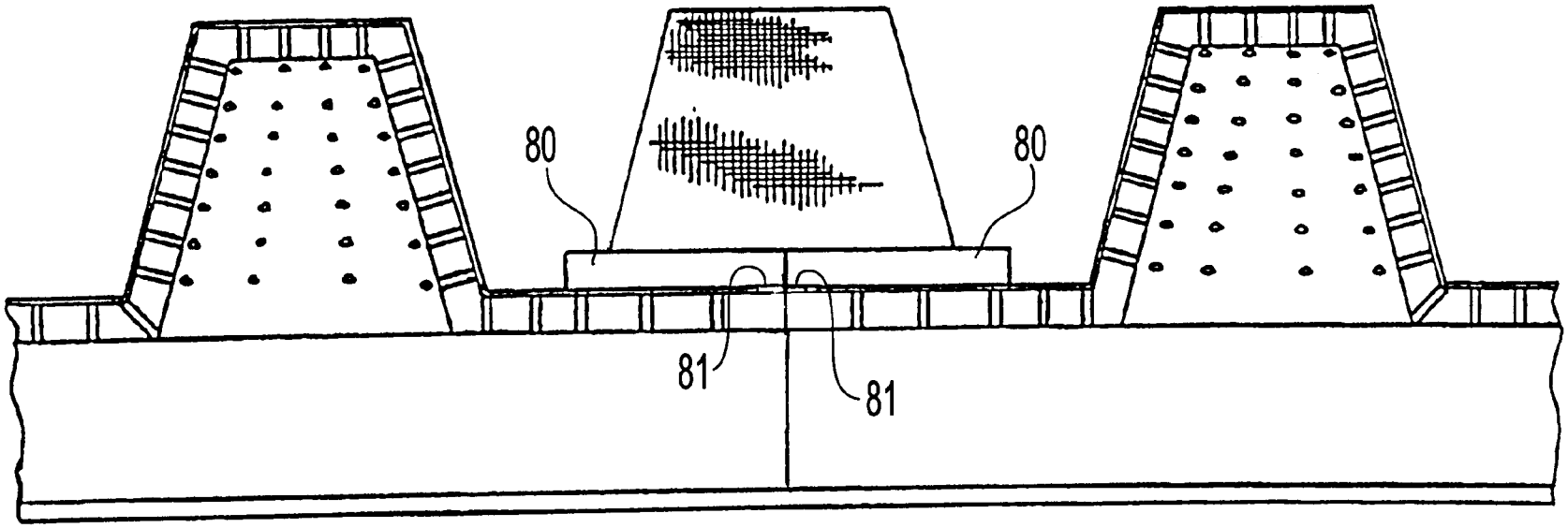
FIG. 7 is a cross-sectional view of a suction mold taken at line Y—Y, shown in FIG. 1, and depicts an alternative masking body used to prevent aspiration of pulp.

Referring to FIG. 7, the suction mould 4, 26 and pressing-and-depositing mould 16, 40 may also include masking bodies 80 in the form of at least one shaped body secured to a modular mould part and situated outside of the article or articles being produced so as to prevent aspiration of pulp material through the perforations in the moulds. The masking bodies 80 may preferably be positioned in mutually adjacent comers 81 of modular mould parts in the mould, which are preferably provided with recesses (not shown) for accommodating the masks, although this is not critical to the invention.

List of parts

| | |
|---|---|
| A | modular mould part |
| B | modular mould part |
| C | article |
| D | article |
| E | article |
| m | edge length |
| 1 | baseplate |
| 2 | rectangular area |
| 3 | perforations |
| 4 | male suction mould |
| 5 | frame |
| 6 | groove |
| 7 | modular mould part |
| 8 | modular mould part |
| 9 | hollow body |
| 10 | base surface |
| 11 | top edge |
| 12 | projection |
| 13 | perforations |
| 14 | internal cavity |
| 15 | wire mesh |
| 16 | pressing-and-depositing mould |
| 17 | frame |
| 18 | modular mould part |
| 19 | modular mould part |
| 20 | hollow body |
| 21 | base surface |
| 22 | edge |
| 23 | recess |
| 24 | perforations |
| 25 | internal cavity |
| 26 | female suction mould |
| 27 | frame section |
| 28 | upper frame section |
| 29 | groove |
| 30 | modular mould part |
| 31 | modular mould part |
| 32 | body |
| 33 | recess |
| 34 | recess |
| 35 | base surface |
| 36 | upper edge |
| 37 | moulding recess |
| 38 | wire mesh |
| 39 | perforations |
| 40 | pressing-and-depositing mould |
| 41 | frame |
| 42 | modular mould part |
| 43 | modular mould part |

-continued

| List of parts | |
|---|---|
| 44 | hollow body |
| 45 | base surface |
| 46 | edge |
| 47 | projection |
| 48 | internal cavity |
| 49 | perforations |

What is claimed is:

1. In a moulding tool for use in a machine for manufacturing individual articles from pulp material by aspirating a layer of pulp material from a liquid suspension on a liquid-permeable moulding surface, wherein said moulding tool comprises a suction mould (4, 26) and an associated pressing-and-depositing mould (16, 40), each being configured and dimensioned to be secured in a pressure-tight manner to a low, elongated box enclosing a chamber adapted to be sequentially connected to a vacuum source and a pressurized-air source, respectively, wherein said suction and pressing-and-depositing moulds (4, 26; 16, 40) comprise mutually facing elements (12, 23; 37, 47) adapted to moulding of the individual articles, wherein each suction and pressing-and-depositing mould (4, 26; 16, 40) comprises a substantially planar baseplate (1) provided with a plurality of perforations (3) to form the base of said elongated box, and wherein the improvement comprises:

a) said baseplate (1) including a modularly divided area (2) which is dividable into a plurality of modules;

b) in a number corresponding to the number of the individual articles, a plurality of modular mould parts (7, 8, 18, 19, 30, 42, 43), each of which is configured and dimensioned to form a respective one of the individual articles and having a base surface (10, 35, 21, 45) disposed parallel to the baseplate (1), and provided with either projections (12, 47) or recesses (23, 37), are removably secured in the modularly divided area (2) of the baseplate (1), said plurality of modular mould parts (7, 8, 18, 19, 30, 31, 42, 43) being positioned substantially adjacent to each other to at least partially cover the modularly divided area; and c) means for masking-off any regions of the modularly divided area (2) on the baseplate (1) not covered by the modular mould parts (7, 8, 18, 19, 30, 31, 42, 43) thereby producing a coherent pulp shell having the individual articles formed therein such that the articles are separable from each other after drying of the pulp material shell in a drying plate of a drier, said means for masking-off being removably secured in the modularly divided area.

2. A moulding tool according to claim 1, wherein the suction mould is a male suction mould (4) and said male suction mould comprises:

a) the modularly divided area (2) of the baseplate (1) of the male suction mould is delimited by a frame (5) of the male suction mould extending upright from the baseplate of the male suction mould, said frame forming an outer side wall of said low, elongated box;

b) each modular mould part (7,8) of said male suction mould comprises a hollow body (9), at least one projection (12) protruding upwardly from said base surface (10), and side walls extending at right angles therefrom towards the baseplate (1) of the male suction mould, the base surface and the projection or projections (12) being provided with a plurality of perforations (13) and covered with wire mesh (15) extending through a distance downwardly along and aligned with the side walls of the modular mould part (7,8) of the male suction mould at right angles to the base surface (10);

c) the base surfaces (10) of each modular mould parts (7,8) of the male suction mould lie in substantially the same plane, substantially at a level lower than an upper edge (11) of the frame (5) of the male suction mould by one wall thickness of the pulp-material shells; and d) said masking means of the male suction mould is a masking body or masking bodies, each of which comprises a hollow body, with a masking surface lying in said plane of the modular mould parts of the male suction mould and masking side walls extending at right angles therefrom towards the baseplate (1) of the male suction mould, said masking surface being provided with perforations and covered with wire mesh extending through a distance downwardly along and aligned with the masking side walls at right angles to said plane of the modular mould parts of the male suction mould.

3. A moulding tool according to claim 2, wherein the pressing-and-depositing mould (16) comprises:

a) the modularly divided area (2) of the baseplate (1) of the pressing-and-depositing mould is delimited by a frame (17) of the pressing-and-depositing mould extending upwardly from the baseplate of the pressing-and-depositing mould, said frame forming an outer side wall of the elongated box;

b) each modular mould part (18,19) of the pressing-and-depositing mould comprises a hollow body (20) having an internal cavity (25) open towards the baseplate (1) of the pressing-and-depositing mould and at least one recess (23) surrounded by said internal cavity (25) and extending inwardly from the base surface (21) and adapted to be placed opposite to the projection or projections (12) on the associated modular mould part (7,8) on the male suction mould (4) and having dimensions greater than those of said projection or projections (12) of said male suction mould by substantially one wall thickness of the pulp-material shell, each recess (23) being provided with perforations (24) leading to the internal cavity (25);

c) the base surfaces (21) of the modular mould parts (18,19) of the pressing-and-depositing mould and the upper edge (22) of the frame (17) of the pressing-and-depositing mould lie in substantially the same plane; and d) said masking means of the pressing-and-depositing mould is a masking body or bodies and each masking body is formed in the shape of a hollow body open towards the baseplate (1), of the pressing-and-depositing mould and including a plane surface lying in said plane of the modular mould parts of the pressing and depositing mould and being provided with perforations.

4. A moulding tool according to claim 3, wherein:

a) said masking means of the pressing-and-depositing mould further comprises at least one non-perforated masking body configured and dimensioned to deter aspiration positioned at at least one mutually adjacent comer of the base surfaces of the modular mould parts of the suction mould, said at least one non-perforated masking body being situated outside of the articles being produced so as to deter aspiration of pulp material; and b) at least one corresponding mutually adjacent comer of the modular mould parts of the pressing-and-depositing mould are provided with recesses for accommodating said at least one non-perforated masking body.

5. A moulding tool according to claim 3, wherein:

a) a surface of each masking body has secured thereon a shaped non-perforated body so as to prevent aspiration of pulp material through the perforation in the masking body; and b) the pressing-and-depositing mould has a recess for accommodating the non-perforated masking body.

6. A moulding tool according to claim 3, wherein:

a) the frame (5, 17) delimiting the modularly divided area (2) of the baseplate (1) of the male suction mould and the pressing-and-depositing mould comprises a small number of standard frames with different heights, and is removably secured on the baseplate of the corresponding male suction mould or pressing-and-depositing mould.

7. The moulding tool according to claim 3, wherein the base surface (21) of each modular mould part of the pressing-and depositing mould is provided with perforations (24) leading to the cavity (25).

8. The moulding tool according to claim 2, wherein the frame (5) of the male suction mould includes an internal surface which is provided with a plurality of upwardly extending grooves.

9. A moulding tool according to claim 1, wherein the suction mould is a female suction mould (26) and the female suction mould comprises:

a) the modularly divided area (2) of the baseplate (1) of the female suction mould is delimited by a frame (27,28) of the female suction mould extending upwardly from the baseplate (1) of the female suction mould, said frame forming an outer side wall of said low, elongated box;

b) each modular mould part (30,31) of the female suction mould comprises a body (32) having in outlines a right angled box-like shape, the sides and bottom thereof being provided with recesses (33,34) open towards the baseplate (1) of the female suction mould, said body (32) comprising side walls extending at right angles from the base surface (35) and at least one moulding recess (37) extending from said base surface (35) of the female suction mould downwardly in the body (32) and surrounded by said recesses (33,34), whereas the base surface (35) of the female suction mould and each moulding recess (37) are covered with wire mesh (38) extending through a distance downwardly along and aligned with the side walls of the modular mould parts (30,31), of the female suction mould, each moulding recess (37) and the base surface (35) of the female suction mould being provided with perforations (39) extending to said recesses (33,34);

c) the base surfaces (35) of the modular mould parts (30,31) of the female suction mould lie in substantially the same plane of the female suction mould, at a level lower than the level of the upper edge (36) of the frame (27,28) of the female suction mould by substantially one wall thickness of the pulp-material shell; and d) said masking means of the female suction mould is a masking body or bodies which comprises a hollow body open towards the baseplate (1) of the female suction mould with a plane surface of the masking body lying in said plane of the female suction mould and side walls of the masking body extending at right angles therefrom, said plane surface of the masking bodies being provided with perforations and covered with wire mesh extending through a distance downwardly along and aligned with the side walls of the masking bodies.

10. A moulding tool according to claim 9, wherein each of said moulding recesses (37) in the modular mould parts (30,31) of the female suction mould have the same depths.

11. A moulding tool according to claim 9, wherein:

a) the moulding recesses in the modular mould parts of the female suction mould have different depths, the modular mould parts with the deepest and equally deep moulding recesses are situated symmetrically on and along at least two opposite sides of the modularly divided area (2) of the baseplate (1) of the female suction mould.

12. A moulding tool according to claim 9, wherein the pressing-and-depositing mould (40) comprises:

a) the modularly divided area (2) of the baseplate (1) of the pressing-and-depositing mound is delimited by a frame (41) of the pressing-and-depositing mould extending upwardly from the baseplate of the pressing-and-depositing mould;

b) each modular mould part (42,43) of the pressing-and-depositing mould comprises a hollow body (44) open towards the baseplate (1) of the pressing-and-depositing mould with at least one projection (47) protruding upwardly from the base surface (45) of the pressing-and-depositing mould, each of said projections (47) being provided with perforations (49) and adapted to be placed facing a mating moulding recess (37) in the associated modular mould part (30,31) in the female suction mould (26) and having dimensions smaller than those of each associated moulding recess (37) of the female suction mould by substantially one wall thickness of the pulp-material shell;

c) the base surfaces (45) of the modular mould parts (42,43) of the pressing-and-depositing mould lie in substantially the same plane as the upper edge (46) of the frame (41) of the pressing-and-depositing mould; and d) said masking means of the pressing-and-depositing mould is a masking body or masking bodies, each of which comprises a hollow masking body with a masking plane surface lying in said plane of the modular mould part of the pressing-and-depositing mould and provided with perforations.

13. A moulding tool according to claim 12, wherein:

a) said masking means of the pressing-and-depositing mould further comprises at least one non-perforated masking body configured and dimensioned to deter aspiration positioned at at least one mutually adjacent comer of the base surfaces of the modular mould parts of the suction mould, said at least one non-perforated masking body being situated outside of the articles being produced so as to deter aspiration of pulp material; and b) at least one corresponding mutually adjacent corner of the modular mould parts of the pressing-and-depositing mould are provided with recesses for accommodating said at least one non-perforated masking body.

14. A moulding tool according to claim 12, wherein:

a) a surface of each masking body has secured thereon a shaped non-perforated body so as to prevent aspiration of pulp material through the perforation in the masking body; and b) the pressing-and-depositing mould has a recess for accommodating the non-perforated masking body.

15. A moulding tool according to claim 12, wherein:

a) the frame (27, 28, 41) delimiting the modularly divided area (2) of the baseplate (1) of the female suction mould and the pressing-and-depositing mould comprises a small number of standard frames with different heights, and is removably secured on the baseplate of the corresponding female suction mould or pressing-and-depositing mould.

16. The moulding tool according to claim 9, wherein the frame (27, 28) of the female suction mould includes an the internal surface which, at least in the uppermost section (28), is provided with upwardly extending grooves (29).

17. In a moulding tool for use in a machine for manufacturing individual articles from pulp material by aspirating a layer of pulp material from a liquid suspension on a liquid-permeable moulding surface, wherein said moulding tool comprises a suction mould (4, 26) and an associated pressing-and-depositing mould (16, 40), each being configured and dimensioned to be secured in a pressure-tight manner to a low, elongated box enclosing a chamber adapted to be sequentially connected to a vacuum source and a pressurized-air source, respectively, wherein said suction and pressing-and-depositing moulds (4, 26; 16, 40) comprise mutually facing elements (12, 23; 37, 47) adapted to moulding of the individual articles, wherein each suction and pressing-and-depositing mould (4, 26; 16, 40) comprises a substantially planar baseplate (1) provided with a plurality of perforations (3) to form the base of said elongated box, and wherein the improvement comprises:

a) said baseplate (1) including a modularly divided area (2) which is dividable into a plurality of modules;

b) in a number corresponding to the number of the individual articles, a plurality of modular mould parts (7, 8, 18, 19, 30, 31, 42, 43), each of which is configured and dimensioned to form a respective one of the individual articles and having a base surface (10, 35, 21, 45) disposed parallel to the baseplate (1), and provided with either projections (12, 47) or recesses (23, 37), are removably secured in the modularly divided area (2) of the baseplate (1), said plurality of modular mould parts (7, 8, 18, 19, 30, 31, 42, 43) being positioned substantially adjacent to each other to at least partially, but not totally, cover the modularly divided area; and c) means for masking-off any regions of the modularly divided area (2) on the baseplate (1) not covered by the modular mould parts (7, 8, 18, 19, 30, 31, 42, 43) thereby producing a coherent pulp shell having the individual articles formed therein such that the articles are separable from each other after drying of the pulp material shell in a drying plate of a drier, said means for masking-off being removably secured in the modularly divided area.

18. In a moulding tool for use in a machine for manufacturing individual articles from pulp material by aspirating a layer of pulp material from a liquid suspension on a liquid-permeable moulding surface, wherein said moulding tool comprises a suction mould (4, 26) and an associated pressing-and-depositing mould (16, 40), each being configured and dimensioned to be secured in a pressure-tight manner to a low, elongated box enclosing a chamber adapted to be sequentially connected to a vacuum source and a pressurized-air source, respectively, wherein said suction and pressing-and-depositing moulds (4, 26; 16, 40) comprise mutually facing elements (12, 23; 37, 47) adapted to moulding of the individual articles, wherein each suction and pressing-and-depositing mould (4, 26; 16, 40) comprises a substantially planar baseplate (1) provided with a plurality of perforations (3) to form the base of said elongated box, and wherein the improvement comprises:

a) said baseplate (1) including a modularly divided area (2) which is dividable into a plurality of modules;

b) in a number corresponding to the number of the individual articles, a plurality of modular mould parts (7, 8, 18, 19, 30, 31, 42, 43), each of which is configured and dimiensioned to form a respective one of the individual articles and having a base surface (10, 35, 21, 45) disposed parallel to the baseplate (1), and provided with either projections (12, 47) or recesses (23, 37), are removably secured in the modularly divided area (2) of the baseplate (1), said plurality of modular mould parts (7, 8, 18, 19, 30, 31, 42, 43) being positioned substantially adjacent to each other to at least partially cover the modularly divided area; and c) at least one masking body for masking any regions of the modularly divided area (2) on the baseplate (1) not covered by the modular mould parts (7, 8, 18, 19, 30, 31, 42, 43) to thereby produce a coherent pulp shell having the individual articles formed therein such that the articles are separable from each other after drying of the pulp material shell in a drying plate of a drier, said means for masking-off being removably secured in the modularly divided area.

* * * * *